United States Patent [19]

Kress et al.

[11] 3,934,918

[45] Jan. 27, 1976

[54] JUNCTION FOR SHEET-LIKE MATERIAL LOAD LIFTING BAND WITH OVERLOAD INDICATOR

[75] Inventors: Heinz Kress, Holzen near Schwerte; Heinz Heckmanns, Ennepetal-Buttenberg, both of Germany

[73] Assignee: Titan Verpackungssysteme GmbH, Schwelm, Germany

[22] Filed: Nov. 16, 1973

[21] Appl. No.: 416,353

[30] Foreign Application Priority Data

Nov. 21, 1972 Germany ..... 2256983

[52] U.S. Cl. ..... 294/74; 24/20 EE; 29/521; 403/27; 403/375

[51] Int. Cl.[2] ..... B66C 1/18

[58] Field of Search ..... 294/74, 78 R, 81 R; 403/285, 27, 375, 393; 52/758 D; 29/21.1, 432, 521; 24/20 EE, 23 EE

[56] References Cited

UNITED STATES PATENTS

| | | | |
|---|---|---|---|
| 1,980,154 | 11/1934 | Coe | 29/521 |
| 3,188,706 | 6/1965 | Partridge | 24/20 EE |
| 3,234,610 | 2/1966 | Timmerbeil et al. | 24/20 EE |
| 3,426,392 | 2/1969 | Timmerbeil | 24/20 EE |
| 3,457,599 | 7/1969 | Timmerbeil et al. | 24/20 EE |
| 3,463,534 | 8/1969 | Norton | 294/74 |
| 3,466,080 | 9/1969 | Norton | 294/74 |
| 3,725,976 | 4/1973 | Mackeown | 403/285 |

*Primary Examiner*—Werner H. Schroeder
*Assistant Examiner*—Conrad L. Berman
*Attorney, Agent, or Firm*—Michael J. Striker

[57] ABSTRACT

A load lifting band with an overload indicator includes a junction for strip material which is particularly useful for joining the ends of a strip of material so as to form a closed band for lifting heavy loads. The junction consists of a pair of overlapping sheet-like sections provided with interconnecting parts. The interconnecting parts each include a plurality of slits and corresponding sheet portions extending from the general plane of the respective section, the sheet portions of one of the sections each cooperating with a pair of slits in the other section so as to prevent separation of the sections in response to a force tending to move the same apart. The slits in each of the sections are divided into two sets each of which includes at least two groups of laterally spaced slits. The number of slits in one group is greater than that in the corresponding other group. The respective sets of slits are mirror symmetrically arranged about a plane which is normal to the general plane of the corresponding section.

5 Claims, 7 Drawing Figures

FIG. 5
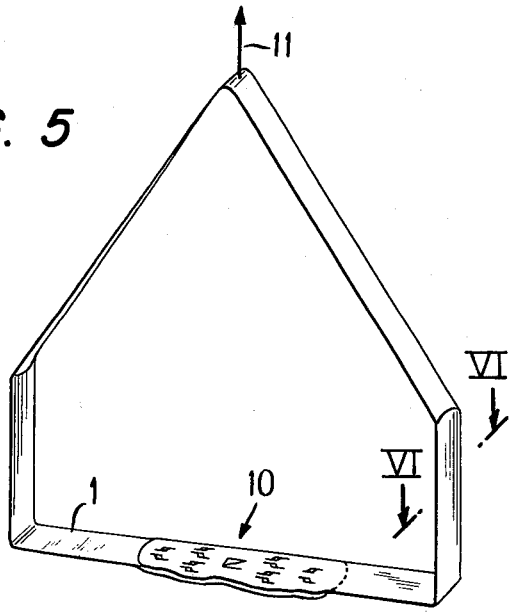
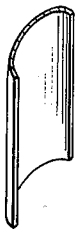
FIG. 6
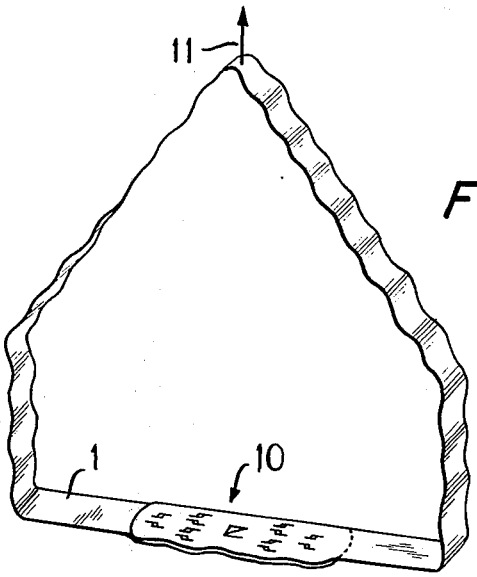
FIG. 7
FIG. 3
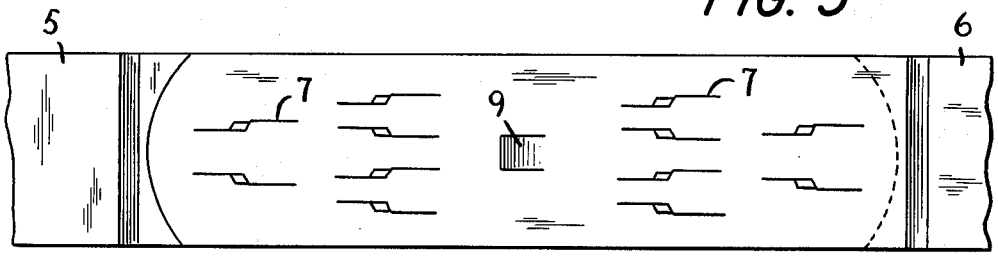
FIG. 4
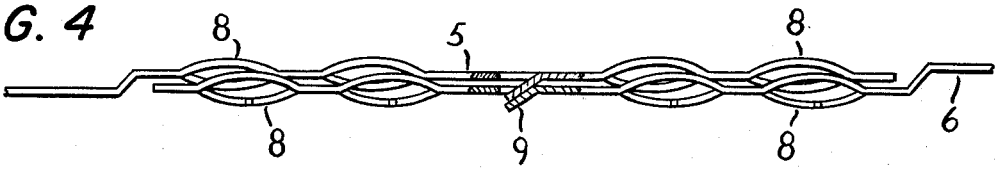

JUNCTION FOR SHEET-LIKE MATERIAL LOAD LIFTING BAND WITH OVERLOAD INDICATOR

BACKGROUND OF THE INVENTION

The invention relates generally to a junction or joint for sheet-like material and, more particularly, to a manner of effecting a connection between overlapping sections of sheet-like material. Of special interest is a band for lifting heavy loads which is made from a strip of material such as steel which has been formed into the shape of a closed loop with the ends of the strip overlapping one another.

The term "sheet-like" or "sheet" as used herein is intended to encompass foils, strips, sheets, webs and the like.

Lifting bands, that is, bands for lifting loads, are used in the transport of elongated material sections such as, for example, steel bars, or rods, which are bound together into the form of bundles by means of wires, for instance, and are transported by a crane or the like. The lifting bands are usually maintained in position about the bundles of goods until these have arrived at their final destination. This eliminates the necessity for providing additional chains or the like for conveying the goods when the latter are transferred from one transporting device to another or when the goods must be moved around internally within the warehouse. Moreover, by maintaining the lifting bands in position about the goods, the work of the person transporting the goods is simplified since the jockeying and experimentation which would otherwise be required to engage the hooks of the crane or transporting device to the wires or other elements which bind the individual material sections into a bundle are greatly reduced.

It is known to make lifting bands for this purpose by forming a steel strip into the form of a closed loop or band with the ends of the strip overlapping one another. The overlapping ends of the strip are then connected to each other by means of electric spot welding. These lifting bands have the disadvantage that they must have large cross-sections if they are to be used for heavy loads. The reason is that they must be made of a steel having a low carbon content and, consequently, low strength, if they are to be spot weldable.

Lifting bands having large cross-sections are unwieldy and are also expensive because of the large quantities of material required to make them. Furthermore, the quality of the spot welds is dependent upon the metallurgical quality and condition of the material used, upon the quality and condition of the surface of the strip and upon the welding apparatus utilized. As a result, it is only possible to obtain an approximate relationship between the breaking load of the material of the band and the breaking load of the connection between the ends of the strip from which the band is made. In other words, the ratio of the strength of the connection to the strength of the material of the band will vary from case to case and will not be constant.

SUMMARY OF THE INVENTION

It is, accordingly, a general object of the invention to provide an improved junction for sheet-like material.

More particularly, it is an object of the invention to provide a junction for overlapping sheet-like sections which is not dependent upon the metallurgical quality and condition of the material used or upon the quality and condition of the surfaces of the sections.

Another object of the invention is to provide a junction for overlapping sheet-like sections such that the strength of the junction will always be in the same relationship to the strength of the material used.

A further object of the invention is to provide a junction for overlapping sheet-like sections such that an optimum load distribution along the junction is always obtained.

It is also an object of the invention to provide a novel band for lifting heavy loads.

More specifically, it is an additional object of the invention to provide a lifting band for heavy loads wherein the junction between the overlapping ends of the strip from which the band is made is secure even when the strip has a small cross-section and wherein the strength of the junction always has the same relationship to the strength of the material from which the band is made.

The above objects, and others which will become apparent from the following description, are achieved, in accordance with the invention, by a junction for sheet-like material which comprises a pair of overlapping sheet-like sections provided with interconnecting parts. The interconnecting parts each include a plurality of slits and corresponding sheet portions extending from the general plane of the respective section. Each of the sheet portions of one of the sections cooperates with a pair of slits in the other sections so as to prevent separation of the sections in response to a force tending to move the same apart. The slits in each of the sections are divided into two sets each of which includes at least two groups of laterally spaced slits with the number of slits in one of the groups being greater than the number of slits in the corresponding other group. The respective sets are substantially mirror symmetrically arranged with respect to a symmetry plane substantially normal to the general plane of and transverse to the corresponding section.

The invention is particularly, although not exclusively, applicable to a band for lifting heavy loads which is produced by shaping a strip of material into the form of a closed loop or band with the end sections of the strip overlapping each other. The end sections of the strip may then be joined in accordance with the teachings herein. The strip may be a steel strip and may have a breaking load of at least 2000 kp. According to the invention, the extent of overlap of the end sections of the strip may be equal to approximately 4.0 to 5.5 times the width of the strip.

In accordance with the invention, the end sections of the strip are provided with slits which have somewhat of a stepped configuration. Furthermore, the end sections are provided with portions which extend from the respective general planes of the same. This may be accomplished by bending portions of the end sections outwardly from the respective general planes thereof so as to form bridge-like members, that is, members which project from the respective general planes of the end sections but each of whose ends is connected with the respective end section. Joining of the end sections is then achieved by the interengagement of the slits and the projecting portions of the respective end sections.

The slits in each of the end sections are, according to the invention, divided into two sets each of which includes at least two groups of slits with the number of slits in one of the groups being greater than the number of slits in the corresponding other group. The sets of slits in each of the end sections are arranged in such a manner that they are substantially mirror symmetrical about a plane substantially normal to the general plane of the respective end section. In an advantageous embodiment of the invention, each set of slits includes two groups of slits with one of the groups consisting of two slits and the corresponding other group consisting of four slits. It is further advantageous in this case when the groups of slits in each of the end sections are so arranged that, proceeding in longitudinal direction of the strip or band, a group of two slits is followed by a group of four slits which latter is, in turn, followed by a group of four slits, the latter finally being followed by a group of two slits. An arrangement of this type assures that an optimum load or stress distribution is obtained along the junction or joint between the end sections. It will be seen that in the exemplary distribution of slits given above, the groups consisting of four slits are located nearest the symmetry plane or, in other words, the groups consisting of four slits are located intermediate the symmetry plane and the corresponding group consisting of two slits.

Each of the end sections may be further provided with an additional portion extending from the general plane thereof. This may be accomplished by stamping or punching a portion of each of the end sections out of the respective general planes of the same. These additional portions overlap one another and serve to prevent unintentional separation of the end sections in the absence of a force on the latter tending to separate them. Advantageously, the additional portion of each of the sections is located intermediate the respective sets of slits thereof and, in the exemplary distribution of slits given above, it is advantageous for the additional portions to be located intermediate the groups consisting of four slits.

Where steel strip is used, the steel from which the strip is made may, for example, have the following composition: 0.40–0.55% by weight of carbon 0.10–0.40% by weight of silicon, 0.40–0.60% by weight of manganese, 0.05–0.15% by weight of copper, 0.010–0.040% by weight of aluminum, at most about 0.05% by weight of phosphorus, and at most about 0.050% by weight of sulfur, the remainder being substantially iron and conventional impurities.

During its manufacture, the strip may be cold rolled to a thickness of about 0.6–1.4 millimeters and it may be continuously patented such as, for instance, in a lead bath. The strip advantageously possesses a tensile strength of 95–160 kp/mm$^2$ and a yield strength corresponding to 75–95% of the tensile strength thereof. It is further favorable when the elongation at fracture of the strip as measured on the basis L=5d, that means for flat crossection $5{,}65 \cdot \sqrt{Ao}$, corresponding DIN50144 (like Euro-Norm 11-55), lies between 5 and 15%.

In accordance with the invention, it is advantageous when at least a portion of that part of the lifting band extending between the end sections is arcuate in transverse direction of the band or is provided with corrugations which extend transversely of the band. Such arcuate or corrugated portions are adapted to flatten at a predetermined load or stress. The reason for this is that lifting bands are normally used several times and, thus, by providing such arcuate or corrugated portions, it becomes possible to determine whether the band has been previously very highly loaded or stressed, that is, whether the band has been previously loaded beyond the predetermined load.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 3 is a plan view of a junction according to the invention;

FIG. 4 is a side view of the junction of FIG. 3;

FIG. 5 is a schematic representation of a lifting band in accordance with the invention configurated so as to permit a determination of whether the lifting band has previously been highly stressed;

FIG. 6 is a view in the direction of the arrows VI–VI of FIG. 5; and

FIG. 7 is a schematic representation of a lifting band in accordance with the invention showing a modification of the configuration of FIG. 5.

DESCRIPTION OF THE PREFERRED EMBODIMENTS

The invention will be described with reference to a band for lifting loads although this is not to be construed as limiting the invention in any manner.

Figure 1:
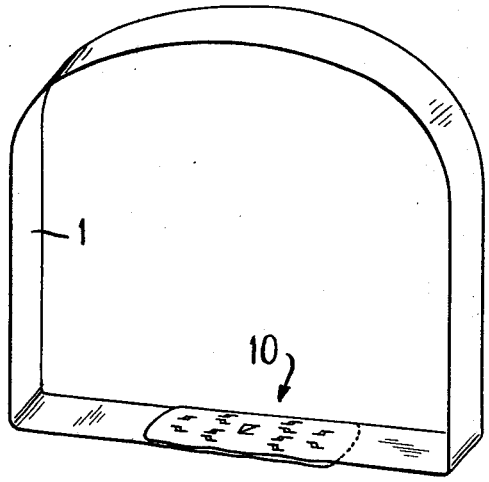
FIG. 1 is a schematic representation of a lifting band in accordance with the invention.

FIG. 1 shows a lifting band 1 according to the invention. The band 1 is produced by forming a strip of material into the shape of a closed loop with the end sections of the strip overlapping one another. The region of overlap of the end sections is indicated generally at 10 and the end sections are joined to each otehr in a manner to be presently described.

Figure 2:
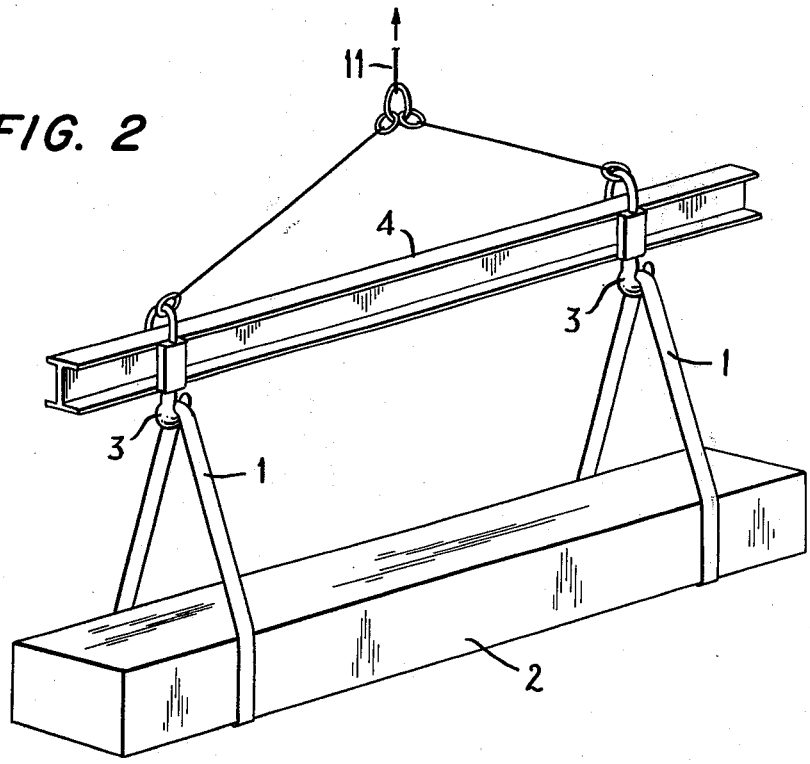
FIG. 2 illustrates schematically a manner in which the lifting band of FIG. 1 may be used for lifting loads.

Referring now to FIG. 2, a manner in which the band 1 may be used for lifting loads is schematically illustrated here. A load of goods 2 is to be lifted in the direction indicated by the arrow 11. The lifting is to be accomplished by means of a non-illustrated crane having a boom 4 provided with hooks 3. A band 1 is slung over each of the hooks 3 and the goods 2 rest on the bands 1 as shown. Due to the weight of the goods 2, the bands 1 undergo elastic deformation as will be apparent from a comparison of FIGS. 1 and 2.

The foregoing short description is intended to provide an illustration of the utility of the invention.

FIGS. 3 and 4 illustrate in detail the junction between the end sections of the lifting band 1, the end sections here being indicated by the reference numerals 5 and 6, respectively. It may be seen that the sections 5 and 6 overlap one another. As most clearly shown in FIG. 3, each of the sections 5 and 6 is provided with a plurality of slits 7. The slits 7 have somewhat of a stepped configuration, that is, in the illustrated embodiment, each of the slits 7 is made up of two slit portions extending in longitudinal direction of the respective end section 5 or 6 with the respective slit portions being laterally offset relative to one another and being connected by another slit portion extending transversely of the respective end section 5 or 6.

The slits 7 are arranged in groups or, in other words, proceeding in longitudinal direction of the end sections 5 and 6 in FIG. 3, it will be seen that there is first a group of two laterally spaced slits 7 which is followed by a group of four laterally spaced ones of the slits 7, the latter group being followed by yet another group of four laterally spaced ones of the slits which, in turn, is followed by a group of two laterally spaced slits 7. Adjacent groups or slits define a set, that is, the groups of two and four on the left-hand side of FIG. 3 together define a first set of slits and the groups of two and four on the right-handed side of FIG. 3 together define a second set of slits. The first and second sets of slits in each of the end sections 5 and 6 are substantially mirror symmetrically arranged about a symmetry plane extending transversely of the respective end section intermediate the groups of four of the respective sets and which is normal to the general plane of the respective end section. It is pointed out here that the symmetry between the respective sets is not a mirror symmetry in the true sense of the term but is actually a symmetry which corresponds to the following two operations: (1) rotation about an axis normal to the general plane of the respective end section and which is located intermediate the groups of four of the respective sets; and (2) reflection in a plane extending transversely of the respective end section intermediate the groups of four of the respective sets and which is normal to the general plane of the respective end section. The sequence in which the above two operations are performed in irrelevant, the end result being the same whether operation 1 precedes or follows operation 2. The term "substantially mirror symmetrical" as used herein is intended to encompass a rotation plus a reflection such as just described.

It will be appreciated from the foregoing description that the arrangement of the groups in the respective sets is such that the number of slits in one of the groups of each set is greater than the number of slits in the other group of the set. Advantageously, although not necessarily, that group of each of the respective sets having the greater number of slits is located nearer the symmetry plane than the group having the lesser number of slits. Of course, it is possible to provide more than two groups of slits in each of the sets in accordance with the principles of the invention.

As best seen in FIG. 4, each of the end sections 5 and 6 is further provided with members or portions 8 extending from the general planes of the same. In the illustrated embodiment, the members 8 are formed by bending portions of the end sections 5 and 6 out of their general planes and thus, in the present instance, the members 8 are bridge-like members, that is, both ends of each of the members 8 are fast with the respective end section. The members 8 are provided in correspondence to the slits 7 or, in other words, the number of the members 8 should bear a relationship to the number of the slits 7. In the embodiment shown, one of the members 8 is provided intermediate each pair of the slits 7. Thus, with reference to FIG. 3, each of the groups of two slits has one of the members 8 located intermediate the pair of slits 7 making up the group. On the other hand, each of the groups of four slits has two of the members 8 located intermediate the slits 7 making up the group, that is, proceeding in transverse direction of the end sections 5 and 6 in FIG. 3 and from either lateral edge thereof, one of the members 8 is located intermediate the first and second slits encountered and another of the members 8 is located intermediate the third and fourth slits encountered. The shape of the members 8 is clearly evident from FIG. 3 and corresponds to the pattern defined by the respective pairs of slits 7 intermediate which the members 8 are located.

With reference again to FIGS. 3 and 4, it may be seen that each of the end sections 5 and 6 is also provided with an additional member or portion 9 extending from the general planes of the same. The members 9 may, for example, be formed by stamping or punching a portion of each of the end sections 5 and 6 out of their general planes. It is advantageous, although not necessary, for the members 9 to be provided intermediate the groups of four of the respective sets of slits as shown.

The junction between the end sections 5 and 6 is due to cooperation between the slits 7 of one of the end sections and the members 8 of the other end section, the slits 7 and members 8 of the end sections 5 and 6 thus defining interconnecting parts. As best seen in FIG. 3, each of the members 8 has a wider portion extending in longitudinal direction of the end sections 5 and 6 and a narrower portion also extending in longitudinal direction of the end sections 5 and 6, the wider portion of each of the members 8 being located to the right of the narrower portion in the illustrated embodiment. The regions between the pairs of slits 7 intermediate which the members 8 are provided have a similar configuration. FIG. 4 indicates the manner in which the junction between the end section 5 and 6 may be achieved. The end sections 5 and 6 are brought into proper overlapping relationship and, in the embodiment shown, this condition corresponds to one in which each of the members 8 of the end sections 5 is located in the region between a pair of slits 7 of the end section 6. It will be appreciated that in this manner separation of the end sections 5 and 6 in response to a force tending to move the end section 5 to the left and the end section 6 to the right will be prevented due to the fact that the wider portion of each of the members 8 of the end section 5 will be prevented from moving past the location where the region intermediate the corresponding pair of slits 7 of the end section 6 narrows. A force tending to move the end section 5 to the left and the end section 6 to the right would, for instance, be generated by the weight of the goods 2 shown in FIG. 2.

FIG. 4 shows that the members 9 of the end sections 5 and 6 overlap one another. The function of the members 9 is to prevent unintentional separation of the end sections 5 and 6 in the absence of a force tending to move the end section 5 to the left and the end section 6 to the right. It will be appreciated that, in the absence of such a force, there exists the possibility for the end section 5 to move towards the right and for the end section 6 to move towards the left. In such an event, uncoupling of the end sections 5 and 6 could occur. This is prevented by the members 9 which cooperate to prevent movement of the end section 5 to the right and the end section 6 to the left. It is, of course, self-understood that the manner of preventing uncoupling of the end sections 5 and 6 described here is merely exemplary and is not to be construed as limiting the invention since other means for preventing separation of the end sections 5 and 6 may also be used.

Since lifting bands such as the bands 1 of FIGS. 1 and 2 are normally used repeatedly, it is desirable to be able to determine if the band has previously been very highly stressed or loaded. FIGS. 5–7 illustrate different configurations which may be imparted to a band 1 in order to make such a determination possible. With reference first to FIG. 5, it may be seen that here the extensions of the end sections of the band 1, that is, that portion of the band 1 extending between the end sections thereof, is arcuately contoured in transverse direction of the band 1. This is more clearly seen in FIG. 6 which is a view in the direction of the arrows VI–IV of FIG. 5. On the other hand, FIG. 7 shows the extensions of the end sections of the band 1 as being provided with corrugations extending in transverse direction of the band 1. The arcuate and corrugated extensions are adapted to flatten at a predetermined load or stress. Thus, when the load applied to the band 1 is of such a magnitude that the region of plastic deformation of the material of the band 1 is attained, the curvature of the arcuate extension or the waviness of the corrugated extensions in the zone of critical loading is lost, that is, at least some flattening of these extensions occurs. It will be appreciated that such flattening makes possible a ready determination whether the band 1 has previously been highly stressed or loaded.

It will be understood that each of the elements described above, or two or more together, may also find a useful application in other types of construction and uses differing from the types described above.

While the invention has been illustrated and described as embodied in a junction for sheet-like material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. A re-usable load-lifting band for lifting of heavy loads, comprising a band having a main section and a pair of overlapping terminal sections which form with said main section a closed loop for lifting of loads having a weight up to a predetermined upper limit; connecting means connecting said terminal sections with one another against separation when said loop supports a load, said connecting means comprising interconnecting parts in said terminal sections and each including a plurality of slits and corresponding sheet portions extending from the general plane of the respective terminal section, each of the sheet portions of the respective terminal section cooperating with a pair of slits in the other terminal section to thereby prevent said separation of said terminal sections under load; and inter-engaging portions having angularly related juxtaposed flange-like portions and juxtaposed openings receiving said flange - like portions on said terminal sections connecting the latter with each other and for retaining them from unintentional separation in the absence of said load, said flange-like portions being of plastically-deformable material which deforms upon the application of a load to said band and permanently visually indicates if the latter has been used to lift the loads having a weight in excess of said predetermined upper limit.

2. A load-lifting device for lifting heavy loads, comprising a rigid but deformable metal band having a main section and a pair of overlapping terminal sections which form with said main section a closed loop for lifting loads having a weight not exceeding a predetermined upper weight limit; connecting means for connecting said terminal sections with one another against separation when said loop supports a load; and indicating means for permanently visually indicating whether the deformable metal band has previously been used to lift a load having a weight in excess of said predetermined upper weight limit, said indicating means consisting (a) in a deformable metal band portion spaced from said overlapping terminal sections of the band and being arcuately curved or corrugated in a direction transverse to the elongation of said deformable metal band and adapted to flatten upon the application to said loop of a load having a weight equal to said predetermined upper weight limit (b) and interengaging portions having angularly related juxtaposed flange-like portions and juxtaposed opening receiving said flange-like portions on said terminal sections connecting the latter with each other and for retaining them from unintentional separation in the absence of said load, said flange-like portions being of plastically-deformable material which deforms upon the application of a load to said band and permanently visually indicates if the latter has been used to lift loads having a weight in excess of said predetermined upper limit 3. A device as defined in claim 2, wherein said connecting means comprises interconnecting parts in said terminal sections each including a plurality of slits and corresponding sheet portions extending from the general plane of the respective terminal section, each of the sheet portions of the respective terminal section cooperating with a pair of slits in the other terminal section to thereby prevent said separation of said terminal sections under load, the slits in each of said terminal sections being divided into two longitudinally adjacent first groups each composed of four laterally adjacent slits and having a free space between one another, two second groups each composed of two laterally adjacent slits and each located longitudinally adjacent one of said first groups but remote from said space; and wherein said terminal sections have a predetermined width, and the extent of overlap of said terminal sections is substantially 4.0 to 5.5 greater than said predetermined width; and further comprising inter-engaging retaining portions in said space for preventing unintentional separation of said sections in the absence of said load.

4. A device as defined in claim 2, wherein said indicating means comprises an extension of at least one of said terminal sections, said extension having a portion which is arcuately curved in direction transverse to the elongation of said band and adapted to flatten upon the application to said loop of a load having a weight equal to said predetermined upper weight limit.

5. A device as defined in claim 2, wherein said indicating means comprises an extension of at least one of said terminal sections, said extension having a portion which is corrugated in direction transverse to the elongation of said band and adapted to flatten upon the application to said loop of a load having a weight equal to said predetermined upper weight limit.

* * * * *